United States Patent [19]

Pinto

[11] Patent Number: 4,769,873

[45] Date of Patent: Sep. 13, 1988

[54] TEXTILE FIBER DISTRIBUTION RAMP FOR FIBER BATT FORMING APPARATUS

[75] Inventor: Akiva Pinto, Gastonia, N.C.

[73] Assignee: Hergeth Hollingsworth GmbH, Duelman, Fed. Rep. of Germany

[21] Appl. No.: 18,253

[22] Filed: Feb. 24, 1987

[51] Int. Cl.[4] ..... D01G 15/40; D01H 5/38

[52] U.S. Cl. ..... 19/105; 406/159

[58] Field of Search ..... 19/105; 406/156, 159, 406/160

[56] References Cited

U.S. PATENT DOCUMENTS

| | | | |
|---|---|---|---|
| 3,728,759 | 4/1973 | Hergeth | 19/105 |
| 3,747,985 | 7/1973 | Merkel et al. | 19/105 |
| 4,404,710 | 9/1983 | Wood | 19/105 |
| 4,523,351 | 6/1985 | Leifeld | 19/105 |
| 4,531,262 | 7/1985 | Reiche | 19/105 X |
| 4,648,754 | 3/1987 | Staheli et al. | 19/105 X |
| 4,661,025 | 4/1987 | Pinto et al. | 19/105 X |
| 4,682,388 | 7/1987 | Pinto | 19/105 |

*Primary Examiner*—Louis K. Rimrodt
*Attorney, Agent, or Firm*—Cort Flint

[57] ABSTRACT

Batt forming apparatus (12) is disclosed having a reserve chute (36) and batt formation chute (76). A fiber entrance duct (40) includes a bottom floor (44) with a stationary floor (48) and a movable floor ramp (50). Ramp (50) may be adjustably inclined to incoming airflow to project fibers in trajectories further across reserve chute (36). This control of fiber distribution may be used to assist in the production of a fiber batt (78) having a homogeneous density structure.

11 Claims, 3 Drawing Sheets

Fig. 5.
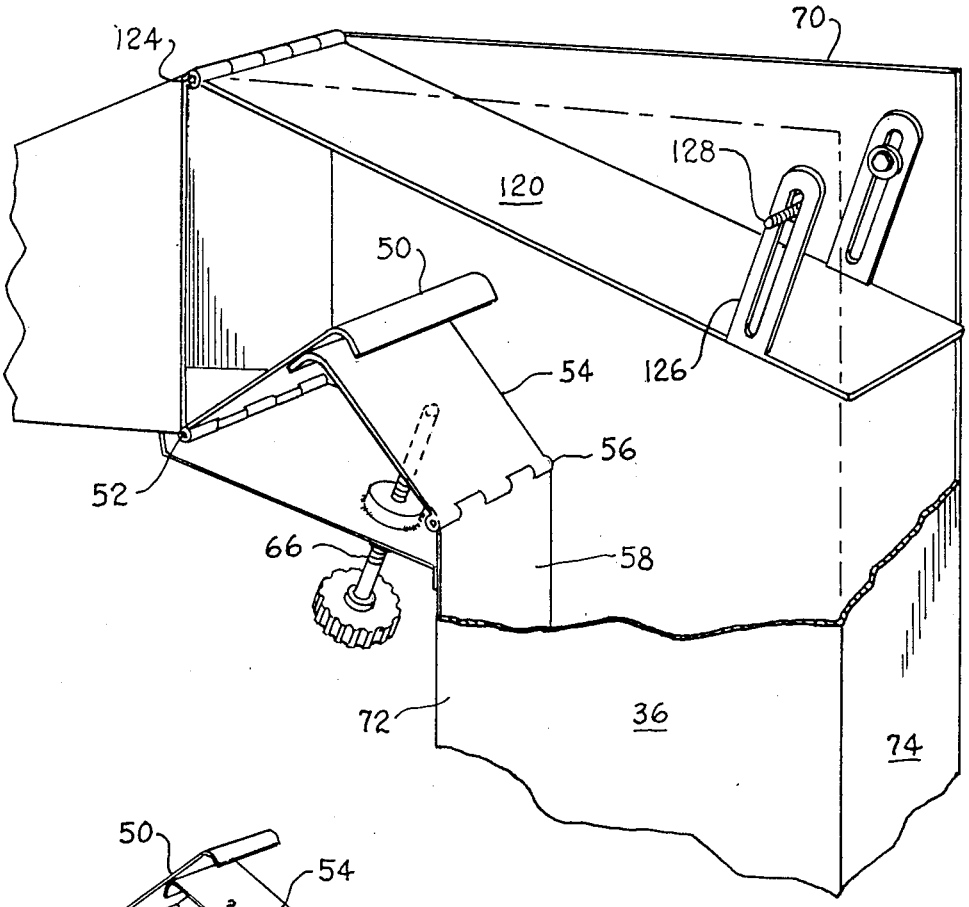
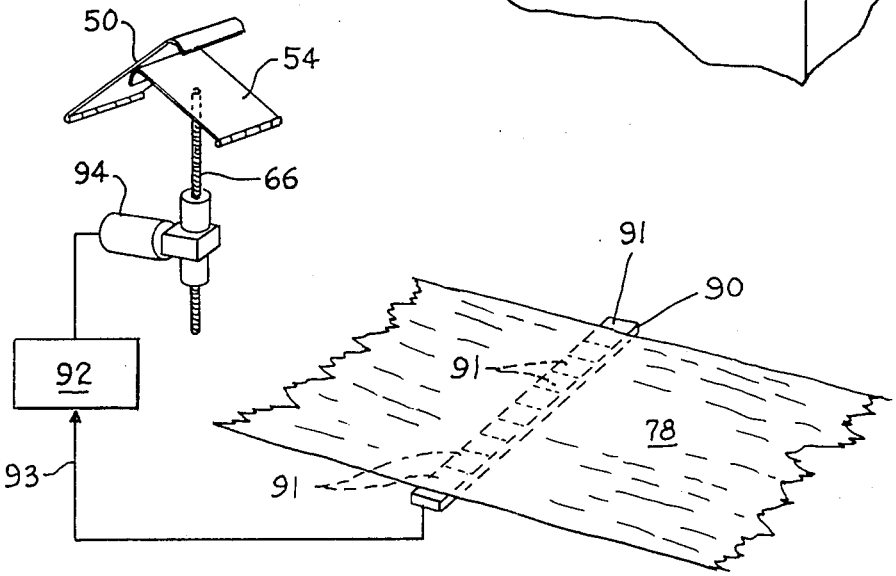
Fig. 6.

TEXTILE FIBER DISTRIBUTION RAMP FOR FIBER BATT FORMING APPARATUS

BACKGROUND OF THE INVENTION

The invention relates to the formation of textile fibers into a densified fiber batt for use in both woven and nonwoven applications. The invention is particularly useful in nonwoven applications where a fiber batt of homogeneous density structure is desired. The object of fiber batt forming apparatus is to receive textile fibers from an airflow and compact the fibers into a fiber batt having a prescribed density structure. The fiber batt may be further processed on a carding machine for the production of sliver. The slivers may then be further processed into yarn for weaving on a loom. The densified fiber batt may also be taken from the batt-forming apparatus and processes as a nonwoven web. In either case, it is highly desirable to control the feeding of fiber to the batt-forming chute to produce a fiber batt having a uniform density in all of its dimensions, i.e. homogeneous density structure.

Typically, batt forming apparatus includes a reserve chute which receives fiber-laden air. The fibers are retained in the chute while the air exits the reserve chute. A feed roll then feeds the stored fibers to a formation chute below the reserve chute. In the formation chute, an oscillating plate compacts the fibers into a densified fiber batt. The densified fiber batt is discharged from the formation chute for further processing on a carding machine and the like.

A problem occurs in controlling the distribution of stored fibers in the reserve chute. It is known that the proper distribution of fibers in the reserve chute can directly affect the density of the fiber batt being formed in the formation chute. It is desirable to be able to have more control over the distribution of fibers in the reserve chute. This control may be used to more effectively assist in the production of a fiber batt of homogeneous density.

In U.S. Pat. No. 4,593,436 it is proposed to provide a deflector plate behind a perforated wall in the reserve chute. The deflector plate may be spaced from the perforated wall and bent relative thereto in order to control the escape of air from the perforated wall. In this manner, the invention is said to control the amount of air leaving the reserve chamber and the distribution of fibers therein. However, the deflector plate is susceptible to coming out of adjustment. The degree of control provided by such an arrangement is limited.

Accordingly, an object of the invention is to provide a simple and reliable manner of controlling the distribution of fiber build-up in a reserve chute in a batt forming device.

Another object of the invention is to provide batt-forming apparatus in which fibers are distributed in a reserve chute according to a prescribed pattern so that a fiber batt is formed haivng desired density properties.

Another object of the invention is to provide batt-forming apparatus in which the projection of fibers across a reserve chute is controlled in accordance with a prescribed fiber distribution and build-up.

Another object of the invention is to provide projection and desired distribution of fibers across the width of a reserve chute by placing an inclined ramp in the path of the incoming fiber-laden airflow to positively control fiber distribution.

SUMMARY OF THE INVENTION

The above objectives are accomplished according to the present invention by providing textile batt-forming apparatus having a reserve chute for receiving and storing fibers in a fiber delivery duct. A fiber entrance duct opens into a side wall of the reserve chute for receiving a flow of fiber-laden air from the delivery duct. A perforated wall section is included in a rear wall of the reserve chute below the fiber entrance opening. The perforated wall section coextends across the rear wall of the reserve chute and permits air to exit the reserve chute while retianing fiber in the chute. A rectangular fiber entrance duct is provided having a bottom floor over which the fiber-laden airflow is conveyed. The bottom floor of the entrance duct includes a stationary bottom floor and an adjustable floor ramp movable relative to the stationary bottom floor. The adjustable ramp has a first position generally parallel to the airflow. The ramp may be moved to any number of inclined positions. The ramp is inclined upwardly from the stationary bottom floor in the direction of the airflow for projecting fibers in the airflow upwardly across the chute towards the opposing side of the reserve chute. In this manner, the fibers are distributed across the chute in front of the perforated wall section in a prescribed profile pattern. In this pattern, air will exit the uncovered portions of the perforated plate producing higher dynamic forces on the column of fibers in that area. In this manner, the weight of fibers under the lower and higher accumulations of fibers across the column may be generally equalized and fed to the formation chute for formation of a homogeneous fiber batt.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 5 is a perspective view with parts cut away of a batt-forming apparatus constructed in accordance with the present invention in the form of an alternate embodiment; and FIG. 6 is a schematic illustration of a control for automatically adjusting the inclination of a fiber distribution ramp according to the invention.

DESCRIPTION OF A PREFERRED EMBODIMENT

Figure 1:
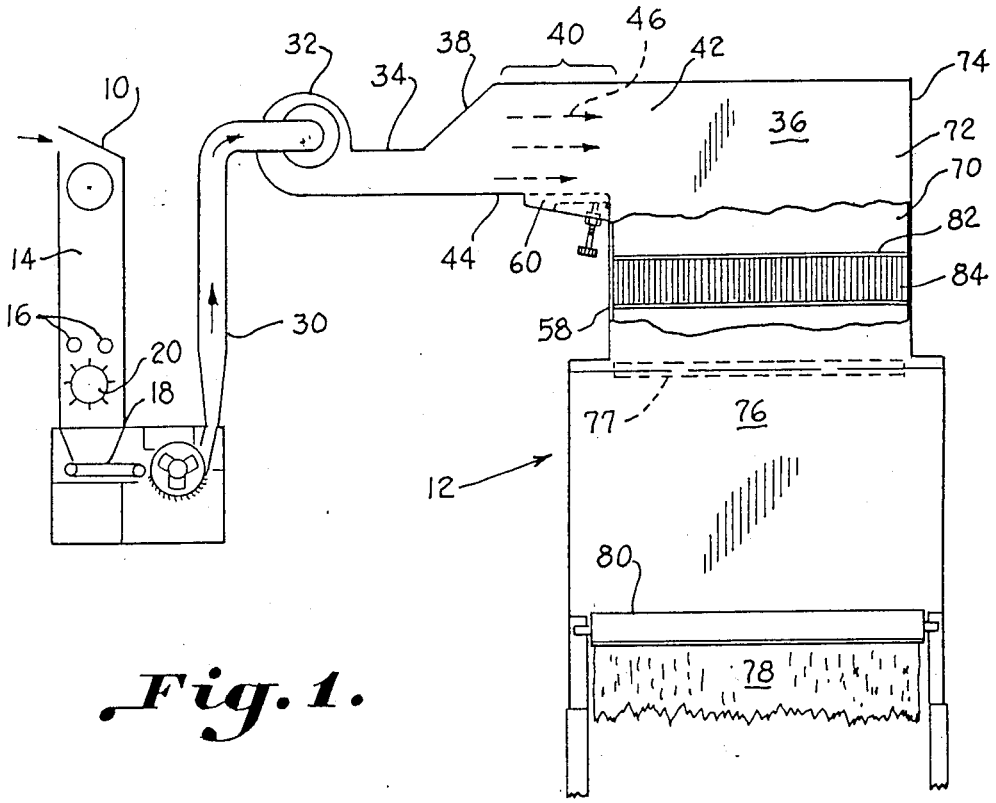
FIG. 1 is a front elevation of batt-forming apparatus constructed in accordance with the present invention.

Referring now in more detail to the drawings, a blow room machine is illustrated in the form of a flock feeder machine 10 for feeding flock pneumatically to a fiber batt-forming machine designated generally as 12 (FIG.

1). Flock feeding machine 10 includes a chute 14, and flock feeder rolls 16 positioned in the chute. Flock feeder rolls 16 feed fiber flock onto an apron 18 by way of an opening roller 20. Apron 18 is driven by an electric drive motor (not shown) in a conventional manner. Feed apron 18 delivers fiber-laden air to a delivery duct 34 into a reserve chute 36 of machine 12. Deliver duct 34 includes a divergent section 38 which terminates at a fiber entrance duct 40 having parallel walls forming a rectangular cross section. Fiber entrance duct 40 has an opening 42 into reserve chute 36.

Figure 2:
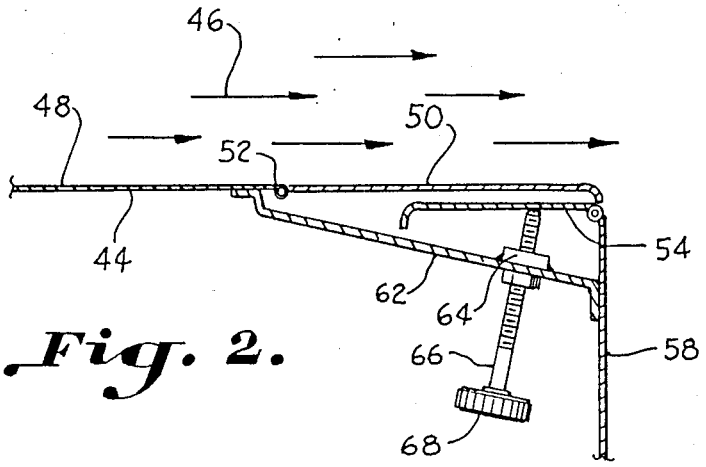
FIG. 2 is a sectional view of the bottom floor structure of a fiber entrance duct constructed according to the invention.

As can best be seen in FIG. 2, fiber entrance duct 40 has a bottom floor 44 parallel to the incoming flow of fiber-laden air as shown by arrows 46. Bottom floor 44 includes a stationary floor 48 and a movable floor. The movable bottom floor is in the form of an adjustable ramp means which includes a pivotal ramp plate 50 hinged at 52 to stationary floor section 48. A second pivotal plate 54 is hinged at 56 to a vertical side wall 58 of reserve chute 36. Pivotal ramp plate 50 and pivotal plate 54 are enclosed by a housing 60 on the bottom of the fiber entrance duct. Enclosure 60 includes the side walls of fiber entrance duct 40 and a lower enclosure 62 which carries a threaded bushing 64. A threaded rod 66 is threadably carried by bushing 64 and includes a turn knob 68. The free end of threaded rod 66 bears against pivotal plate 54. By threading rod 66 in and out, pivotal plate 54 may be raised and lowered to bear against pivotal ramp plate 50 to adjust its inclination, as can best be seen in FIGS. 3 through 6.

Reserve chute 36 includes a back wall 70 and a front wall 72. First side wall 58 and a second opposing side wall 74 are integral with the front and back walls.

A formation chute 76 is below reserve chute 36. A feed roll 77 is disposed between reserve chute 36 and formation chute 76 for feeding fibers from the reserve chute to the formation chute in a conventional manner. In the formation chute, an oscillating plate compacts fibers into a fiber batt 78 which is discharged from the formation chute by a delivery roll 80. Details of the feed roll, oscillating plate, and other conventional features of a chute feed or batt-forming machine may be had by reference to U.S. Pat. No. 4,476,611, which disclosure is incorporated in this application by reference.

Below the entrance duct leading into reserve chute is a perforated wall section 82 which coextends with the back wall 70 of the reserve chute as can best be seen in FIG. 1. The height of perforated wall section 82 is less than the total height of the reserve chute. The perforated wall section may be in the form of a reed having narrow slot openings 84, or may be in the form of a plate having circular or other openings. The openings of the perforated wall section must be large enough to allow air to escape rapidly while retaining fibers in the reserve chute. Fibers remaining in reserve chute 36 may pile up in front of perforated wall section 82 in a level manner or in another distribution pattern. It may be desirable to distribute the fibers in a desired pattern depending upon the application being made of the fiber batt and the type of fibers being processed.

As discussed previously, the density of discharged fiber batt 70 along its length and width is usually needed to be homogeneous. If fibers are accumulated and fed from reserve chute 36 into formation chute 76 in a nonuniform manner, then a fiber batt 78 may be formed whose density varies. For example, if the column of fibers above the feed roll is not level or not uniform in density, then discharged fiber batt 78 may be nonuniform. The resulting uneven weight distribution along the axis of feed roll 77 extending across the reserve chute causes a nonuniform column of fibers to be fed and formed in the formation chute. If the fiber column in the reserve chute is heavier, i.e. more dense, on one side than the other, discharged batt 78 may be also on a corresponding side of the batt.

It is often difficult to control the distribution of fibers in reserve chute 36 and the formation of a uniform column of fibers for feeding by the feed roll to the formation chute.

As can best be seen in FIG. 6, a sensor 90 may be utilized to sense the density of batt 78 as a function of weight per unit volume of the batt 80 across its width and along its length as the batt travels over the sensor. The signal from the sensor representing the density measurements of the batt may be fed to a control means 92. The control means 92 may be a conventional program controller programmed to control the position of threaded rod 66 in response to a signal 93 representing batt density per section area. The sectional areas are prescribed measuring sections 91 across the width of discharged batt 78. A conventional motor controller 94 may be utilized which includes a motor and suitable gearing connected to threaded rod 66 to move it up and down in response to signal 93. In this manner, the inclination of pivotal ramp plate 50 may be adjusted to distribute fibers in reserve chute 36 as needed to assist in forming a batt having a homogeneous or other density structure.

Figure 3:
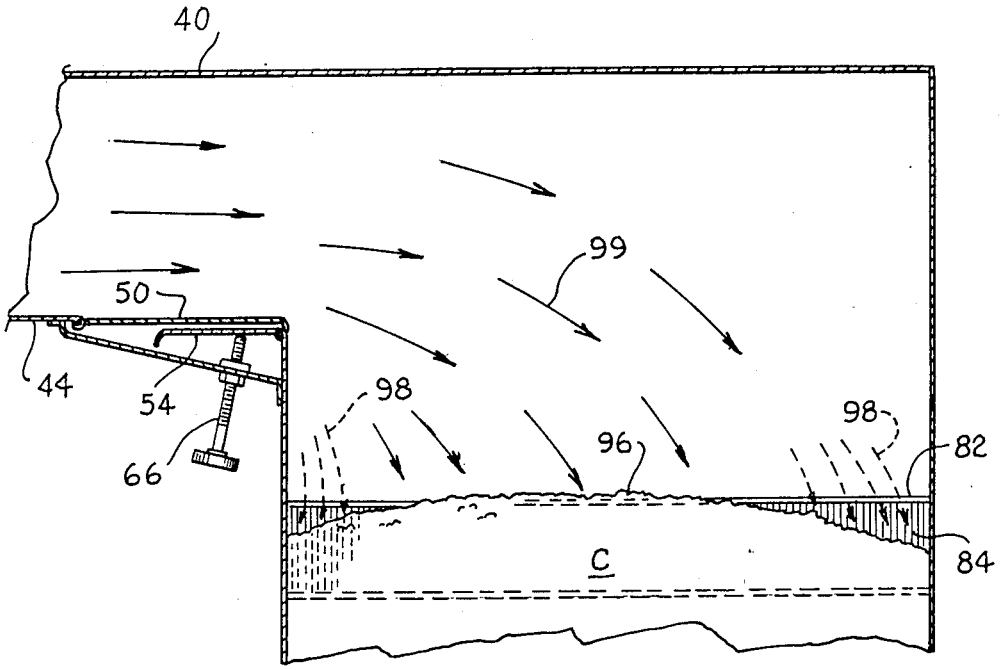
FIG. 3 is an enlarged elevation with parts cut away of the batt-forming apparatus of FIG. 1 with a fiber distribution floor ramp in a level position.
Figure 4:
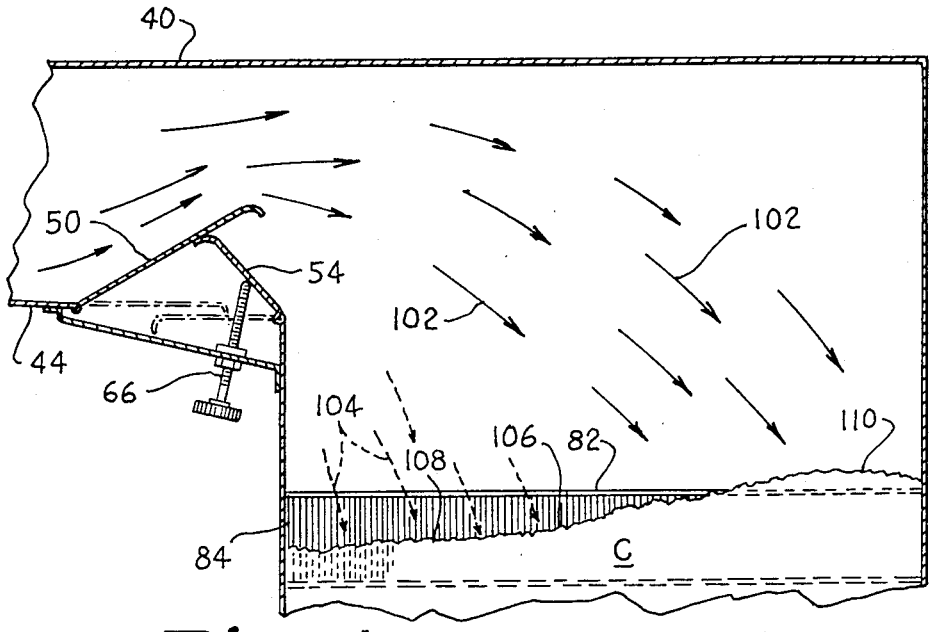
FIG. 4 is an enlarged elevation of the batt-forming apparatus of FIG. 1 with parts cut away illustrating the fiber distribution ramp in an inclined position.

Operation of the apparatus will now be described by reference to FIGS. 3 and 4. In FIG. 3, pivotal ramp plate 50 is in a first lowered position wherein it forms a parallel continuation of bottom floor 44 of entrance duct 40. Pivotal ramp plate 50 terminates in a smooth continuous manner at side wall 58 of the reserve chute. In this manner, the incoming airflow is generally parallel and fiber may be deposited in reserve chute 36 as illustrated. This airflow may result in a number of fiber distribution patterns depending upon various factors which influence the fiber distribution such as velocity degree of fiber opening, friction between the duct walls, amount of fiber in the airflow, etc. Typically, the fibers will assume a curved profile in front of perforated wall section 82.

In the illustrated fiber distribution, the accumulated fibers have a curved profile 96 in front of perforated wall 82. More fibers "F" are accumulated in the center than at the sides of fiber column "C". The main flow of fibers is shown in solid arrow lines 99. More perforations 84 are uncovered in areas where the fiber profile is lower. Air shown in dotted lines 98 rushes through the uncovered areas producing higher dynamic forces on the fibers in the column in those areas. The density of the fiber column will be higher in those areas tending to equalize the weight across the chute and effects of unlevel fiber distribution. Generally, the density curve will be the inverse to the fiber distribution profile.

The density of fiber batt 78 may deviate from that desired and will be sensed by sensor 90. This may require changing the inclination of ramp plate 50 to distribute fibers in reserve chute 36 in a manner that the batt density is brought back to that desired.

For example, should more fibers be needed in the right side of fiber column "C", pivotal ramp plate 50 is raised to a second, inclined position. In this position the pivotal plate is inclined upwardly in the direction of airflow. The fibers are projected in trajectories further toward side wall 74 of the reserve chute. The momentum of the fibers carries them across the chute, and the fibers may be distributed in a generally sinusoidal profile as can best be seen in FIG. 4. The trajectories of the fibers are shown in solid arrows at 102 while the airflow escaping through perforated wall section 82 is shown in dotted lines 104.

In this case, fibers are projected further to the side wall 74. The fiber profile 106 is lower at 108 leaving the perforated wall seciton 82 more uncovered. The fiber profile is higher at 110 covering the perforated wall section. Air 104 exits the uncovered perforations of wall section 82 producing higher forces on the fiber column and greater fiber density under the lower fiber profile. A density curve is produced for fiber column "C" which is inverse to the fiber profile curve.

Of course, the illustrations are for exemplary purposes only, and many fiber distribution patterns and adjustments of their profiles may be had in accordance with the invention depending on the incoming flow conditions and inclination of floor ramp plate 50.

Referring to FIG. 5, another embodiment of the invention is illustrated wherein an imperforate pivotal vane 120 coextends across the top of fiber delivery duct 40 and reserve chute 36. Vane 120 has a pivot 124 and may be adjusted in its inclination downward into incoming airflow to deflect the flow in order to further refine the adjustment of fiber distribution. Slotted brackets 126 and set screws 128 provide means for adjustment of the inclination. Incoming airflow may be deflected from horizontal to vertical across the chute as desired in order to adjust fiber distribution. Addition details of the operation may be had by referring to commonly owned copending application Ser. No. 758,342, filed July 24, 1985, and incorporated in this application by reference.

It is to be understood that fiber distribution ramp 50 and chute 36 may be used without lower formation chute 76 in some applications. In this case, air pressure alone may be utilized to compact the fibers in column "c" and produce a densified fiber batt which is discharged from chute 36 directly to an associated machine. Air pressure and the position of ramp platos 50, 54 may be adjusted to produce a batt having a desired fiber density structure.

While a prefered embodiment of the invention has been described using specific terms, such description is for illustrative purposes only, and it is to be understood that changes and variations may be made without departing from the spirit or scope of the following claims.

What is claimed is:

1. Textile batt-forming apparatus for receiving textile fibers from a fiber delivery duct carrying a flow of fiber-laden air and forming a densified fiber batt from said fibers comprising:

a reserve chute for receiving and storing said fibers from said duct, said reserve chute having a rear wall, front wall, and first and second side walls integrally joining said rear and front walls;

a formation chute below said reserve chute receiving fibers from said reserve chute for compacting said fibers and discharging said fibers in the form of a densified fiber batt;

fiber feed means carried between said reserve and formation chutes for feeding fibers from said reserve chute to said fiber chute;

a fiber entrance duct opening into said first side wall of said reserve chute for receiving said flow of fiber-laden air from said fiber delivery duct and conveying said flow into said reserve chute;

a perforated wall section included in said rear wall a distance below said fiber entrance duct opening, said perforated wall section having a width generally coextending with said rear wall of said reserve chute;

said perforated wall section permitting air to exit said reserve chute while retaining said fiber in said chute;

said fiber entrance duct having a bottom floor over which airflow is conveyed in said entrance duct which includes a stationary bottom floor;

said bottom floor including adjustable ramp means movable relative to said stationary bottom floor having a first position generally parallel to said airflow;

said ramp means having a second position inclined upwardly from said stationary bottom floor in the direction of said airflow for projecting said fibers in said airflow upwardly across said chute toward said second side wall in a manner that a desired distribution of fibers may be had across said chute in front of said perforated wall section t provide a densified fiber batt having a desired density structure and control means for sensing the density of said discharged fiber batt and generating a representative density signal and for controlling said adjustment means in response to said density signal to adjust said ramp means inclination and fiber distribution across said chute to maintain a prescribed fiber density structure in said fiber batt.

2. The apparatus of claim 1 including adjustment means for adjusting the inclination of said ramp means in a number of positions for distributing fibers across said chute to block said perforated wall section according to a prescribed fiber profile across the width of said perforated wall section.

3. The apparatus of claim 1 wherein said ramp means includes a pivotal ramp plate lying generally flush and providing a continuation of said duct stationary bottom floor which terminates generally adjacent said first side wall of said chute in said first position.

4. The apparatus of claim 3 wherein said ramp means includes a second plate which extends from adjacent said first side wall to said ramp plate in said second position to form a ramp enclosure extending from said stationary bottom floor of said entry duct to said side wall of said reserve chute assisting in an orderly flow into said chute.

5. The apparatus of claim 4 wherein said adjustment means includes an operator carried by said entrance duct for moving said second plate which in turn moves said ramp plate.

6. The apparatus of claim 1 including a bottom housing carried by said fiber entry duct generally below the level of said stationary bottom floor, for housing said ramp means, said ramp means forming an upper closure for said housing.

7. The apparatus of claim 1 wherein said ramp means includes a ramp enclosure extending generally from said stationary bottom floor to said first side wall of said reserve chute to prevent air flow beneath said ramp means and facilitate a uniform air flow into said chute.

8. Textile batt forming apparatus for receiving textile fibers from a fiber delivery duct carrying a flow of fiber-laden air and forming a densified fiber batt from said fibers comprising:

a reserve chute for receiving and storing said fibers from said duct;

a formation chute below said reserve chute receiving fibers from said reserve chute for compacting said fibers and discharging said fibers in the form of a densified fiber batt;

fiber feed means carried between said reserve and formation chute for feeding fibers from said reserve chute to said fiber chute;

a fiber delivery entrance opening into a side wall of said reserve chute connected to said fiber delivery duct for receiving fibers into said reserve chute;

adjustable airflow ramp means carried adjacent said entrance inclined upwardly in the direction of said fiber-laden airflow for projecting said fibers in said airflow in trajectories upwardly across said reserve chute for distribution across said chute in a prescribed pattern for proper feeding of fibers to said formation chute therebelow and production of a fiber batt having a desired density structure;

said ramp means including a pivotal ramp plate lying generally flush and providing a continuation of a duct stationary bottom floor which terminates generally adjacent said first side wall of said chute in said first position;

a second pivotal plate pivotally carried adjacent said first side wall which extends from said first side wall to said ramp plate in said second position to form a ramp enclosure assisting in an orderly flow into said chute; and said ramp enclosure extending generally from said stationary bottom floor to said first side wall of said reserve chute to prevent air flow beneath said ramp means and facilitate a uniform air flow into said chute.

9. The apparatus of claim 8 including a perforated wall section included in a back wall of said reserve chute having a height which terminates a distance below said fiber delivery entrance and a width extending generally across the entire width of said reserve chute, said fibers being projected across said chute to distribute said fibers across the width of said chute and block said perforated wall at varying levels so that a first number of said perforations in said wall section are covered and a second number of said perforations are uncovered.

10. The apparatus of claim 8 including adjustment means for adjusting the inclination of said ramp means in a number of positions for altering the distribution of fibers across said chute and corresponding adjust the density structure of said fiber batt.

11. Textile batt-forming apparatus for receiving textile fibers from a fiber delivery duct carrying a flow of fiber-laden air and forming a densified fiber batt from said fibers comprising:

a chute for receiving said fibers from said duct, said chute having a rear wall, front wall, and first and second side walls integrally joining said rear and front walls;

a fiber entrance duct opening into said first side wall of said chute for receiving said flow of fiber-laden air from said fiber delivery duct and conveying said flow into said chute;

a perforated wall section included in said rear wall a distance below said fiber entrance duct opening, said perforated wall section having a width generally coextending with said rear wall of said chute;

said perforated wall section permitting air to exit said reserve chute while retaining said fiber in said chute;

said fiber entrance duct having a bottom floor over which airflow is conveyed in said entrance duct which includes a stationary bottom floor;

said bottom floor including adjustable ramp means movable relative to said stationary bottom floor having a first position generally parallel to said airflow;

said ramp means having a second position inclined upwardly from said sttionary bottom floor in the direction of said airflow for projecting said fibers in said airflow upwardly across said chute toward said second side wall in a manner that a desired distribution of fibers may be had across said chute in front of said perforated wall section to provide a densified fiber batt having a desired density structure; and control means for sensing the density of said discharged fiber batt and generating a representative density signal and for controlling said adjustment means in response to said density signal to adjust said ramp means inclination and fiber distribution across said chute to maintain a prescribed fiber density structure in said fiber batt.

* * * * *